US008149186B2

(12) United States Patent
Kim

(10) Patent No.: US 8,149,186 B2
(45) Date of Patent: Apr. 3, 2012

(54) PIXEL, ORGANIC LIGHT EMITTING DISPLAY USING THE SAME, AND ASSOCIATED METHODS

(75) Inventor: Yang-Wan Kim, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 1018 days.

(21) Appl. No.: 12/081,105

(22) Filed: Apr. 10, 2008

(65) Prior Publication Data

US 2009/0027310 A1 Jan. 29, 2009

(30) Foreign Application Priority Data

Apr. 10, 2007 (KR) ..... 10-2007-0035007

(51) Int. Cl.
*G09G 3/30* (2006.01)

(52) U.S. Cl. ..... 345/76; 315/169.3

(58) Field of Classification Search ..... 345/76, 345/77, 82; 326/82, 83; 313/486, 500, 505–507; 315/169.3; 327/108–112
See application file for complete search history.

(56) References Cited

U.S. PATENT DOCUMENTS

| | | | | |
|---|---|---|---|---|
| 7,339,562 | B2 | 3/2008 | Ikeda | |
| 7,414,599 | B2 | 8/2008 | Chung et al. | |
| 7,443,366 | B2 | 10/2008 | Choi et al. | |
| 2004/0174354 | A1 | 9/2004 | Ono et al. | |
| 2005/0200575 | A1 | 9/2005 | Kim et al. | |
| 2006/0022305 | A1 | 2/2006 | Yamashita | |
| 2006/0023551 | A1 | 2/2006 | Peng et al. | |
| 2006/0038754 | A1 | 2/2006 | Kim | |
| 2006/0103324 | A1 | 5/2006 | Kim et al. | |
| 2006/0145964 | A1 * | 7/2006 | Park et al. | 345/76 |
| 2006/0145967 | A1 * | 7/2006 | Huh | 345/76 |
| 2006/0253755 | A1 | 11/2006 | Wu | |

FOREIGN PATENT DOCUMENTS

| | | | |
|---|---|---|---|
| CN | 1601594 | A | 3/2005 |
| CN | 1677470 | A | 10/2005 |
| CN | 1728219 | A | 2/2006 |
| EP | 1585100 | A1 | 10/2005 |

(Continued)

OTHER PUBLICATIONS

Choi, S.M., et al., "A Self-compensated Voltage Programming Pixel Structure for Active-Matrix Organic Light Emitting Diodes", IDW'03, pp. 535-538 (2003) [XP08057381].

(Continued)

*Primary Examiner* — Amare Mengistu
*Assistant Examiner* — Stacy Khoo
(74) *Attorney, Agent, or Firm* — Lee & Morse, P.C.

(57) ABSTRACT

A pixel including an organic light emitting diode, a second transistor controlling a current supplied to the organic light emitting diode, a pixel circuit configured to compensate a threshold voltage of the second transistor; and a compensating unit controlling a voltage of a gate electrode of the second transistor in order to compensate for deterioration of the organic light emitting diode. The compensating unit includes seventh and eighth transistors coupled in series between the organic light emitting diode and a first power source, the seventh and eight transistors being commonly connected to a fourth node therebetween, first and second feedback capacitors coupled in series between the fourth node and a second node, the second node being coupled to the gate electrode of the second transistor, and a ninth transistor coupled between a predetermined voltage source and a fifth node that is common to the first and second feedback capacitors.

25 Claims, 5 Drawing Sheets

FOREIGN PATENT DOCUMENTS

| | | | |
|---|---|---|---|
| EP | 1 968 039 | A1 | 9/2008 |
| EP | 1 970 885 | A1 | 9/2008 |
| JP | 06-266313 | | 9/1994 |
| JP | 2003-263129 | | 9/2003 |
| JP | 2005-308868 | A | 4/2005 |
| JP | 2005-189695 | A | 7/2005 |
| JP | 2005-520191 | A | 7/2005 |
| JP | 2006-038963 | A | 2/2006 |
| JP | 2006-038965 | A | 2/2006 |
| JP | 2006-138953 | A | 6/2006 |
| JP | 2006-146219 | A | 6/2006 |
| JP | 2006-276253 | A | 10/2006 |
| JP | 2008-122906 | A | 5/2008 |
| KR | 10-2002-0054850 | A | 7/2002 |
| KR | 10-2004-0008922 | A | 1/2004 |
| KR | 10-2005-0005646 | A | 1/2005 |
| KR | 10-2005-0116206 | A | 12/2005 |
| KR | 10-2005-0123328 | A | 12/2005 |
| KR | 10-2006-0033376 | A | 4/2006 |
| KR | 10-2006-0048924 | A | 5/2006 |
| KR | 10-2006-0054603 | A | 5/2006 |
| KR | 10-2007-0019463 | A | 2/2007 |
| WO | WO 03-077229 | A1 | 9/2003 |

OTHER PUBLICATIONS

Chinese Patent Gazette in CN 200810091613.5, dated Dec. 15, 2010 (Kim).

* cited by examiner

PIXEL, ORGANIC LIGHT EMITTING DISPLAY USING THE SAME, AND ASSOCIATED METHODS

BACKGROUND OF THE INVENTION

1. Field of the Invention

Embodiments relate to a pixel, an organic light emitting display using the same, and associated methods, in which degradation of an organic light emitting diode is automatically compensated.

2. Description of the Related Art

In the manufacture and operation of a display, e.g., a display used to reproduce text, images, video, etc., uniform operation of pixel elements of the display is highly desirable. However, providing such uniform operation may be difficult. For example, in some display technologies, e.g., those utilizing electroluminescent elements such as organic light emitting diodes (OLEDs), operational characteristics, e.g., luminance, of the pixel elements may change over time. Accordingly, there is a need for a display adapted to compensate for changes in the operational characteristics of pixel elements.

SUMMARY OF THE INVENTION

Embodiments are therefore directed to a pixel, an organic light emitting display using the same, and associated methods, which substantially overcome one or more of the problems due to the limitations and disadvantages of the related art.

It is therefore a feature of an embodiment to provide a pixel, a display using the same, and associated methods, in which a drive transistor for an OLED is controlled by a voltage that is adjusted in accordance with a degradation of the OLED.

At least one of the above and other features and advantages may be realized by providing a pixel, including an organic light emitting diode, a second transistor controlling a current supplied to the organic light emitting diode, a pixel circuit configured to compensate a threshold voltage of the second transistor, and a compensating unit controlling a voltage of a gate electrode of the second transistor in order to compensate for deterioration of the organic light emitting diode. The compensating unit includes seventh and eighth transistors coupled in series between the organic light emitting diode and a first power source, the seventh and eight transistors being commonly connected to a fourth node therebetween, first and second feedback capacitors coupled in series between the fourth node and a second node, the second node being coupled to the gate electrode of the second transistor, and a ninth transistor coupled between a predetermined voltage source and a fifth node that is common to the first and second feedback capacitors.

The pixel circuit may includes a first transistor having a gate electrode coupled to an $i^{th}$ scan line, the first transistor being turned-on to couple a data line to a first electrode of the second transistor when a scan signal is supplied to the $i^{th}$ scan line, a third transistor having a gate electrode coupled to the $i^{th}$ scan line, the third transistor being turned-on to couple a second electrode of the second transistor to the second node when the scan signal is supplied to the $i^{th}$ scan line, a sixth transistor having a gate electrode coupled to an $i-1^{th}$ scan line, the sixth transistor being turned-on to couple an initialization power source to the second node when a scan signal is supplied to the $i-1^{th}$ scan line, a fourth transistor having a gate electrode coupled to an $i^{th}$ light emitting control line, the fourth transistor being turned-on to couple the first electrode of the second transistor to the first power source when a light emitting control signal is not supplied to the $i^{th}$ light emitting control line, a fifth transistor having a gate electrode coupled to the $i^{th}$ light emitting control line, the fifth transistor being turned-on to couple the second electrode of the second transistor to the organic light emitting diode when the light emitting control signal is not supplied to the $i^{th}$ light emitting control line, and a storage capacitor coupled between the second node and the first power source.

The predetermined voltage source may be the initialization power source. The seventh and eighth transistors may operate in opposition to one another. The eighth and ninth transistors may operate in opposition to one another. The eighth transistor may be a PMOS transistor and the ninth transistor may be an NMOS transistor. The predetermined voltage source may be the first power source. The seventh and eighth transistors may have gate electrodes coupled to an $i+2^{th}$ light emission control line, and the seventh transistor may be an NMOS transistor and the eighth transistor may be a PMOS transistor.

At least one of the above and other features and advantages may be realized by providing a display, including a scan driver coupled to scan lines and light emitting control lines, a data driver coupled to data lines; and a plurality of pixels coupled to the scan lines, the data lines, and the light emitting control lines. Each of the pixels may include an organic light emitting diode, a second transistor controlling a current supplied to the organic light emitting diode, a pixel circuit configured to compensate a threshold voltage of the second transistor, and a compensating unit controlling a voltage of a gate electrode of the second transistor in order to compensate for deterioration of the organic light emitting diode. The compensating unit may include seventh and eighth transistors coupled in series between the organic light emitting diode and a first power source, the seventh and eight transistors being commonly connected to a fourth node therebetween, first and second feedback capacitors coupled in series between the fourth node and a second node, the second node being coupled to the gate electrode of the second transistor, and a ninth transistor coupled between a predetermined voltage source and a fifth node that is common to the first and second feedback capacitors.

The pixel circuit may include a first transistor having a gate electrode coupled to an $i^{th}$ scan line, the first transistor being turned-on to couple a data line to a first electrode of the second transistor when a scan signal is supplied to the $i^{th}$ scan line, a third transistor having a gate electrode coupled to the $i^{th}$ scan line, the third transistor being turned-on to couple a second electrode of the second transistor to the second node when the scan signal is supplied to the $i^{th}$ scan line, a sixth transistor having a gate electrode coupled to an $i-1^{th}$ scan line, the sixth transistor being turned-on to couple an initialization power source to the second node when a scan signal is supplied to the $i-1^{th}$ scan line, a fourth transistor having a gate electrode coupled to an $i^{th}$ light emitting control line, the fourth transistor being turned-on to couple the first electrode of the second transistor to the first power source when a light emitting control signal is not supplied to the $i^{th}$ light emitting control line, a fifth transistor having a gate electrode coupled to the $i^{th}$ light emitting control line, the fifth transistor being turned-on to couple the second electrode of the second transistor to the organic light emitting diode when the light emitting control signal is not supplied to the $i^{th}$ light emitting control line, and a storage capacitor coupled between the second node and the first power source.

The initialization power source may be set to a voltage that is lower than a voltage of a data signal applied to the data line.

The scan driver may supply a light emitting control signal to the $i^{th}$ light emitting control line such that it overlaps with scan signals supplied to the $i-1^{th}$ scan line and the $i^{th}$ scan line, and the scan driver may supply a light emitting control signal to an $i+1^{th}$ light emitting control line such that it overlaps with scan signals supplied to the $i^{th}$ scan line and an $i+1^{th}$ scan line. The seventh transistor may be turned on when the scan signal is supplied to the $i+1^{th}$ scan line, and the eighth transistor may be turned off when the light emitting control signal is supplied to the $i+1^{th}$ light emitting control line. The eighth and ninth transistors may operate in opposition to one another. The eighth transistor may be a PMOS transistor and the ninth transistor may be an NMOS transistor.

The scan driver may supply a light emitting control signal to an $i+2^{th}$ light emitting control line such that it overlaps with the scan signal supplied to the $i+1^{th}$ scan line, the seventh transistor may be turned on when the light emitting control signal is supplied to the $i+2^{th}$ light emitting control line, and the eighth transistor may be turned off when the light emitting control signal is supplied to the $i+2^{th}$ light emitting control line. The seventh and eighth transistors may have gate electrodes coupled to the $i+2^{th}$ light emission control line, the seventh transistor may be an NMOS transistor, and the eighth transistor may be a PMOS transistor.

The predetermined voltage source may be the initialization power source. The initialization power source may initialize a voltage of the gate electrode of the second transistor, and the third transistor may diode-connect the second transistor to charge a voltage corresponding to a threshold voltage of the second transistor and a data signal in the storage capacitor. The seventh transistor may couple the fourth node to the organic light emitting diode while a current is supplied to the organic light emitting diode, such that a voltage at the organic light emitting diode is applied to the fourth node, subsequently, the eight transistor may couple the fourth node to the first power source, such that the voltage of the fourth node is raised to the voltage of the first power source, and the first and second feedback capacitors may transmit the voltage rise of the fourth node to the second node. The seventh and eighth transistors may operate in opposition to one another.

At least one of the above and other features and advantages may be realized by providing a method of driving a display having seventh and eighth transistors coupled in series between an anode electrode of an organic light emitting diode and a first power source, and first feedback and second feedback capacitors coupled in series between a fourth node, which is a node common to the seventh and eighth transistors, and a gate electrode of a driving transistor, the method including initializing a voltage of the gate electrode of the driving transistor with a voltage of an initialization power source, charging a voltage corresponding to a threshold voltage of the driving transistor and a data signal in a storage capacitor by diode-connecting the driving transistor, supplying a current corresponding to the voltage charged in the storage capacitor to the organic light emitting diode, applying a voltage applied to the organic light emitting diode to the fourth node, maintaining a fifth node, which is common to the first and second feedback capacitors, at a constant voltage while charging the voltage in the storage capacitor and supplying the voltage applied to the organic light emitting diode to the fourth node, and controlling the voltage of the gate electrode of the driving transistor by setting the fifth node to a floating state and, at the same time, raising the voltage of the fourth node to the voltage of the first power source.

The constant voltage may be the voltage supplied from any one of the initialization power source and the first power source. The initialization power source may be set to a voltage that is lower than that of the data signal. The seventh and eighth transistors may operate in opposition to one another.

BRIEF DESCRIPTION OF THE DRAWINGS

The above and other features and advantages will become more apparent to those of ordinary skill in the art by describing in detail exemplary embodiments thereof with reference to the attached drawings, in which.

DETAILED DESCRIPTION OF THE INVENTION

Figure 1:
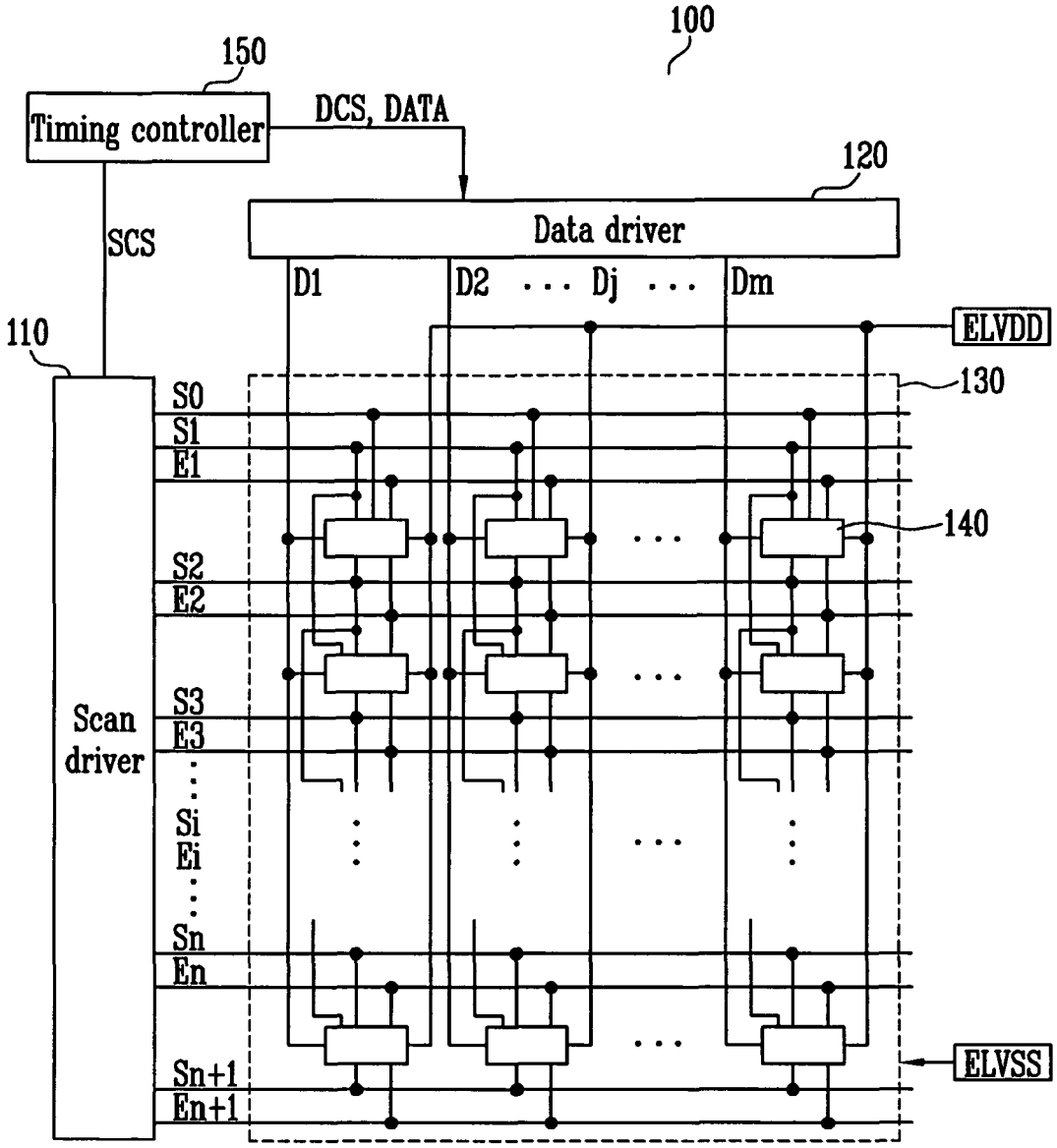
FIG. 1 illustrates a schematic view of an organic light emitting display according to a first embodiment.

Korean Patent Application No. 10-2007-0035007, filed on Apr. 10, 2007, in the Korean Intellectual Property Office, and entitled: "Pixel, Organic Light Emitting Display and Driving Method Thereof," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated, or elements may be omitted, for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present.

Similarly, where an element is described as being coupled to a second element, the element may be directly coupled to the second element, or may be indirectly coupled to the second element via one or more other elements. Further, where an element is described as being coupled to a second element, it will be understood that the elements may be electrically coupled, e.g., in the case of transistors, capacitors, power sources, nodes, etc. Where two or more elements are described as being coupled to a node, the elements may be directly coupled to the node, or may be coupled via conductive features to which the node is common. Thus, where embodiments are described or illustrated as having two or more elements that are coupled at a common point, it will be appreciated that the elements may be coupled at respective points on a conductive feature that extends between the respective points. Like reference numerals refer to like elements throughout.

As used herein, in the context of PMOS transistors, when a scan signal is described as being supplied, the scan signal has a LOW polarity, and when the scan signal is described as being stopped, the scan signal has a HIGH polarity. Further, when a light emitting control signal is described as being supplied, the light emitting control signal has a HIGH polarity, and when the light emitting control signal is described as being stopped, the light emitting control signal has a LOW polarity. When signals are described as overlapping, the signals are concurrently supplied.

Figure 2:
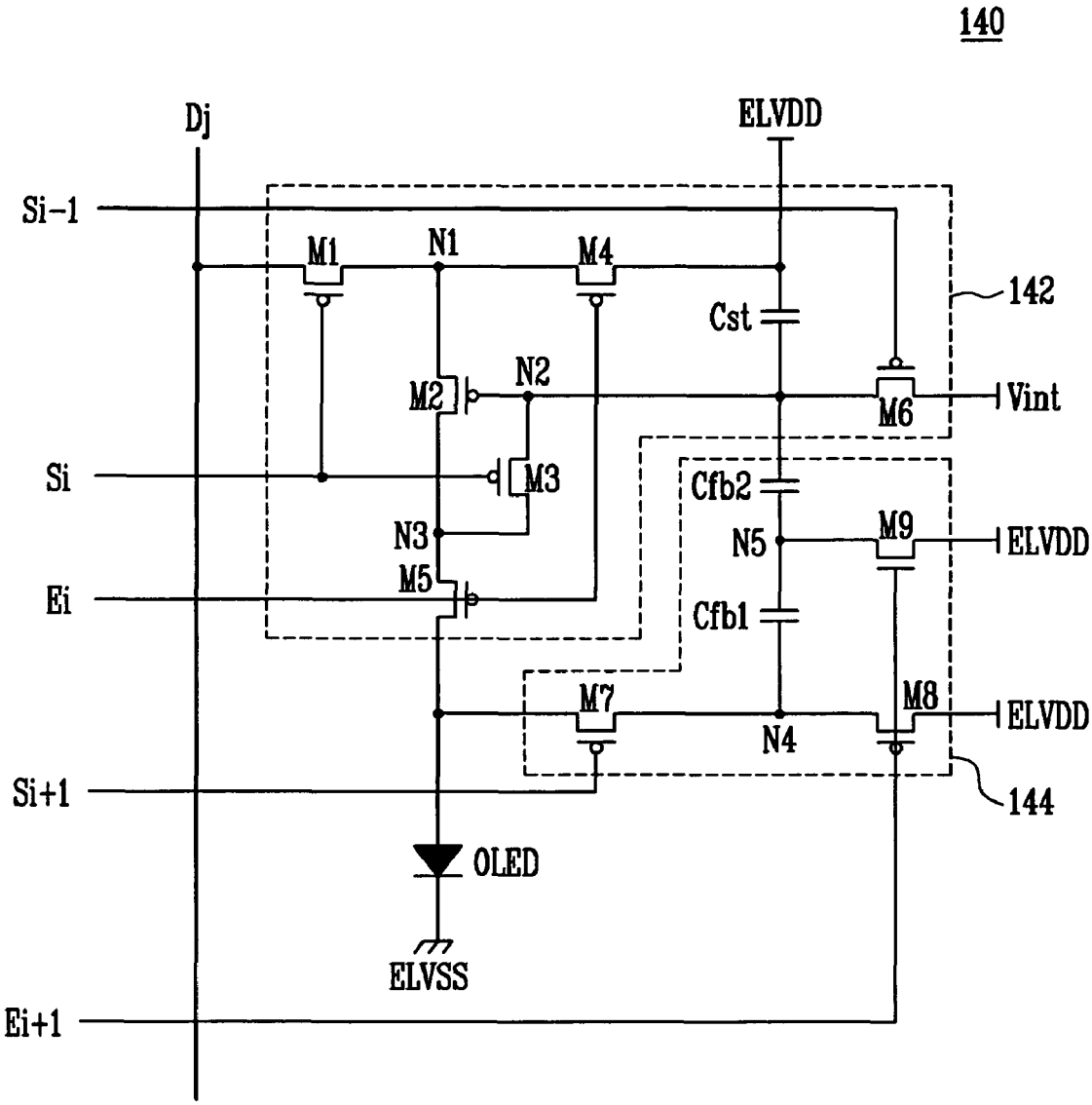
FIG. 2 illustrates a schematic view of a pixel according to the first embodiment.

FIG. 1 illustrates a schematic view of an organic light emitting display 100 according to a first embodiment, and FIG. 2 illustrates a schematic view of a pixel 140 according to the first embodiment. Referring to FIG. 1, the organic light emitting display 100 may include a pixel unit 130 including pixels 140 coupled to scan lines S0 to Sn+1, light emitting control lines E1 to En+1, and data lines D1 to Dm. The organic light emitting display 100 may further include a scan driver 110 for driving the scan lines S0 to Sn+1 and the light emitting control lines E1 to En+1, a data driver for driving the data lines D1 to Dm, and a timing controller 150 for controlling the scan driver 110 and the data driver 120.

The scan driver 110 may be supplied with a scan driving control signal SCS from the timing controller 150. The scan driver 110 may generate scan signals in response to the scan driving control signal SCS and sequentially supply the generated scan signals to the scan lines S0 to Sn+1. The scan driver 110 may also generate light emitting control signals in response to the scan driving control signal SCS and sequentially supply the generated light emitting control signals to the light emitting control lines E1 to En+1.

Figure 3:
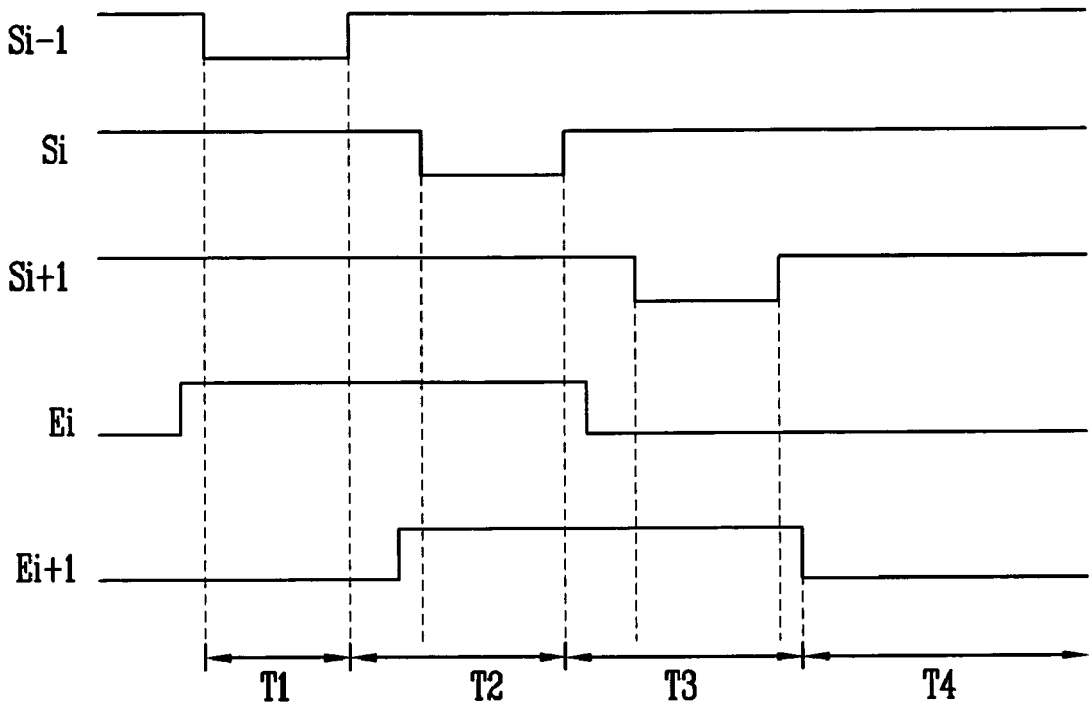
FIG. 3 illustrates waveforms for driving the pixel illustrated in FIG. 2.

FIG. 3 illustrates waveforms for driving the pixel illustrated in FIG. 2 Referring to FIG. 3, a pulse width of the light emitting control signal may be greater than a pulse width of the scan signal. The light emitting control signal supplied to an $i^{th}$ light emitting control line Ei (i is a natural number from 1 to n, inclusive) may overlap with the scan signals supplied to an $i-1^{th}$ scan line Si−1 and an $i^{th}$ scan line Si. The polarity of the pulse of the light emitting control signal may be different, e.g., opposite, from the polarity of the pulse of the scan signal. For example, if the scan line is set to a low polarity, the light emitting control signal may be set to a high polarity.

The data driver 120 may be supplied with the data driving control signal DSC from the timing controller 150. The data driver 120 may generate data signals in response to the data driving control signal DCS, and may sequentially supply the generated data signals to the data lines D1 to Dm in synchronization with the scan signals.

The timing controller 150 may generate the data driving control signal DCS and the scan driving control signal SCS corresponding to externally supplied synchronizing signals. The data driving control signal DCS generated from the timing controller 150 may be supplied to the data driver 120, and the scan driving control signal SCS may be supplied to the scan driver 110. The timing controller 150 may also supply externally-provided data DATA to the data driver 120.

The pixel unit 130 may be supplied with voltages of a first power source ELVDD and a second power source ELVSS, and may distribute the voltages to each pixel 140. The first and second power sources ELVDD and ELVSS may be external to the pixel unit 130.

Each pixel 140 may generate light, e.g., one of red (R), green (G), or blue (B), corresponding to the data signals. The pixel 140 may generate light having a desired brightness by compensating for deterioration of an organic light emitting diode (OLED) included in the pixel 140, such as deterioration that results in an increase in resistance of the organic light emitting diode (OLED). Further, the pixel 140 may compensate for changes in the threshold voltage of a driving transistor included in the pixel 140. The pixel 140 may be provided with a compensating unit 144 for compensating the deterioration of the organic light emitting diode (OLED) and a pixel circuit 142 that compensates for the threshold voltage of the driving transistor.

For convenience of explanation, FIG. 2 illustrates only a pixel 140 positioned at $i^{th}$ horizontal line and coupled to a $j^{th}$ data line Dj (j is a natural number from 1 to m, inclusive). Referring to FIGS. 1 and 2, in order to drive the compensating unit 144 and the pixel circuit 142 included in the pixel 140, the pixel 140 positioned at the $i^{th}$ horizontal line may be coupled to the $i-1^{th}$ scan line Si−1, the $i^{th}$ scan line Si, the $i+1^{th}$ scan line Si+1, the $i^{th}$ light emitting control line Ei, and the $i+1^{th}$ light emitting control line.

Referring to FIG. 2, the pixels 140 according to the first embodiment may include an organic light emitting diode (OLED), the pixel circuit 142 that compensates for the threshold voltage of a second transistor M2 (driving transistor) supplying current to the organic light emitting diode (OLED), and the compensating unit 144 that compensates for the deterioration of the organic light emitting diode (OLED). The compensating unit 144 may control the voltage of a second node N2 coupled to a gate electrode of the second transistor M2 by lowering the voltage as the organic light emitting diode (OLED) deteriorates, in order to compensate for the deterioration of the organic light emitting diode (OLED).

An anode electrode of the organic light emitting diode (OLED) may be coupled to the pixel circuit 142, and a cathode electrode of the organic light emitting diode (OLED) may be coupled to the second power source ELVSS. The organic light emitting diode (OLED) may generate a predetermined brightness of light corresponding to an amount of current supplied from the second transistor M2. The first power source ELVDD may be set to a voltage higher than that of the second power source ELVSS. The pixel circuit 142 may supply current to the organic light emitting diode (OLED) and compensate for the threshold voltage of the second transistor M2, and may include first to sixth transistors M1 to M6, and a storage capacitor Cst.

A gate electrode of the first transistor M1 may be coupled to the $i^{th}$ scan line Si, and a first electrode of the first transistor M1 may be coupled to the data line Dj. A second electrode of the first transistor M1 may be coupled to a first electrode of the second transistor M2 via a first node N1. The first transistor M1 may be turned-on when the scan signal is supplied to the $i^{th}$ scan line Si, and may thus supply a data signal from the data line Dj to the first electrode of the second transistor M2.

The gate electrode of the second transistor M2 may be coupled to the second node N2, and a first electrode of the second transistor M2 may be coupled to the second electrode of the first transistor M1 via the first node N1. A second electrode of the second transistor M2 may be coupled to a first electrode of the fifth transistor M5 via a third node N3. The second transistor M2 may supply current, in correspondence with a voltage applied to the second node N2, to the organic light emitting diode (OLED).

A first electrode of the third transistor M3 may be coupled to the second electrode of the second transistor M2 via the third node N3, and a second electrode of the third transistor M3 may be coupled to the second node N2. A gate electrode of the third transistor M3 may be coupled to the $i^{th}$ scan line Si. The third transistor M3 may be turned-on when the scan signal is supplied to the $i^{th}$ scan line Si, and may thus diode-connect the second transistor M2.

A first electrode of the fourth transistor M4 may be coupled to the first power source ELVDD, and a second electrode of the fourth transistor M4 may be coupled to the first electrode of the second transistor M2 via the first node N1. A gate electrode of the fourth transistor M4 may be coupled to the $i^{th}$ light emitting control line Ei. The fourth transistor M4 may be turned-on when the light emitting control signal is not supplied to the $i^{th}$ light emitting control line Ei, and may thus electrically connect the first power source ELVDD to the first electrode of the second transistor M2 via the first node N1.

A first electrode of the fifth transistor M5 may be coupled to the second electrode of the second transistor M2 via the third node N3, and a second electrode of the fifth transistor M5 may be coupled to the organic light emitting diode (OLED). A gate electrode of the sixth transistor may be coupled to the $i^{th}$ light emitting control line Ei. The fifth transistor M5 may be turned-on when the light emitting control line is not supplied to the $i^{th}$ light control line En, and may thus electrically connect the second transistor M2 to the organic light emitting diode (OLED).

A first electrode of the sixth transistor M6 may be coupled to the second node N2, and a second electrode of the sixth transistor M6 may be coupled to an initialization power source Vint. A gate electrode of the sixth transistor M6 may be coupled to the $i-1^{th}$ scan line Si−1. The sixth transistor M6 may be turned-on when the scan signal is supplied to the $i-1^{th}$ scan line Si−1, and may thus initialize the voltage of the second node N2 with the initialization power source Vint.

The storage capacitor Cst may be coupled between the second node N2 and the first power source ELVDD. The storage capacitor Cst may be charged with a predetermined voltage corresponding to the voltage applied to the second node N2.

The compensating unit 144 may control, via the second node N2, the voltage of the gate electrode of the second transistor M2 in correspondence with deterioration of the organic light emitting diode (OLED). For example, the compensating unit 144 may control the voltage of the second node N2 to be lowered as the organic light emitting diode (OLED) is deteriorated, thereby compensating for the deterioration of the organic light emitting diode (OLED). The compensating unit 144 may include seventh to ninth transistors M7 to M9, a first feedback capacitor Cfb1, and a second feedback capacitor Cfb2.

A first electrode of the seventh transistor M7 may be coupled to a fourth node N4 and a second electrode of the seventh transistor M7 may be coupled to an anode electrode of the organic light emitting diode (OLED). A gate electrode of the seventh transistor M7 may be coupled to the $i+1^{th}$ scan line Si+1. The seventh transistor M7 may be turned-on when the scan signal is supplied to the $i+1^{th}$ scan line Si+1, and may thus electrically connect the fourth node N4 to the organic light emitting diode (OLED).

A first electrode of the eighth transistor M8 may be coupled to the first power source ELVDD, and a second electrode of the eighth transistor M8 may be coupled to the fourth node N4. A gate electrode of the eighth transistor M8 may be coupled to the $i+1^{th}$ light emitting control line Ei+1. The eighth transistor M8 may be turned-on when the light emitting control signal is not supplied to the $i+1^{th}$ light emitting control line Ei+1, and may thus electrically connect the first power source ELVDD to the fourth node N4.

A first terminal of the first feedback capacitor Cfb1 may be coupled to the fourth node N4, and a second terminal of the first feedback capacitor Cfb1 may be coupled to a fifth node N5, which may be common to the first and second feedback capacitors Cfb1 and Cfb2. The first feedback capacitor Cfb1 may change the voltage of the fifth node N5 corresponding to an amount of change in voltage of the fourth node N4.

A first terminal of the second feedback capacitor Cfb2 may be coupled to the fifth node N5, and a second terminal of the second feedback capacitor Cfb2 may be coupled to the second node N2. The feedback capacitor Cfb2 may change the voltage of the second node N2 corresponding to an amount of change in voltage of the fifth node N5.

As described above, the first feedback capacitor Cfb1 and the second feedback capacitor Cfb2 may be coupled between the fourth node N4 and the second node N2, and may change the voltage of the second node N2 corresponding to the amount of change in voltage of the fourth node N4.

A first electrode of the ninth electrode N9 may be coupled to the first power source ELVDD, and a second electrode of the ninth electrode N9 may be coupled to the fifth node N5. A gate electrode of the ninth transistor M9 may be coupled to the $i+1^{th}$ light emitting control line Ei+1. The ninth transistor M9 may be turned-on when the light emitting control signal is supplied to the $i+1^{th}$ light emitting control line Ei+1, and may thus electrically connect the fifth node N5 to the first power source ELVDD. The ninth transistor M9 may have a conductivity type that is different from the other transistors M1 to M8. For example, if the transistors M1 to M8 are PMOS transistors, the ninth transistor M9 may be an NMOS transistor.

Operation of the above-described pixel 140 will now be described in connection with the waveforms illustrated in FIG. 3. Referring to FIGS. 2 and 3, during a first period T1 illustrated in FIG. 3, the scan signal may be supplied to the scan line Si−1, and the light emitting control signal may be supplied to the $i^{th}$ light emitting control signal Ei.

When the light emitting control signal is supplied to the light emitting control line Ei, the fourth transistor M4 and the fifth transistor M5 may be turned-off, and when the scan signal is supplied to the scan line Si−1, the sixth transistor M6 may be turned-on. Accordingly, when the sixth transistor M6 is turned-on, the second node N2 may be initialized with the voltage of the initialization power source Vint. The initialization power source Vint may be set to a voltage that is lower than that of the data signal.

During a second period T2, the supply of the scan signal to the scan line Si−1 may stop, while the supply of the light emitting control signal to the light emitting control line Ei+1 may be maintained. When the supply of the scan signal to the scan line Si−1 stops, the sixth transistor M6 may be turned-off. Further, during the second period T2, the scan signal supplied to the subsequent scan line Si may turn on the first transistor M1 and the third transistor M3. When the third transistor M3 is turned-on, the second transistor M2 may be diode-connected. Further, when the first transistor M1 is turned-on, the data signal from the data line Dj may be supplied to the first electrode of the second transistor M2.

As described above, the voltage of the second node N2 may be initialized with the voltage of the initialization power source Vint during the first period T1, and the second transistor M2 may be turned-on. Accordingly, the data signal supplied via the first transistor M1 may be supplied to the second node N2 via the second transistor M2 and the third transistor M3. Thus, the second node N2 may be supplied with a signal, the voltage of which corresponds to the data signal and the threshold voltage of the second transistor M2. The storage capacitor Cst may be charged with a voltage corresponding to the voltage supplied to the second node N2.

Also during the second period T2, when the light emitting control signal is supplied to the $i+1^{th}$ light emitting control line Ei+1, the ninth transistor M9 may be turned-on and the eighth transistor M8 may be turned-off. When the ninth transistor M9 is turned-on, the voltage of the first power source ELVDD may be supplied to the fifth node N5. Thus, the fifth node N5 may maintain the voltage of the first power source ELVDD during the period when the voltage corresponding to the data signal is applied.

During a third period T3, the light emitting control signal supplied to the light emitting control line Ei and the scan signal supplied to the scan line Si may stop. When the supply of the scan signal to the scan line Si stops, the first transistor M1 and the third transistor M3 may be turned-off. When the supply of the light emitting control signal to the light emitting control line Ei stops, the fourth transistor M4 and the fifth transistor M5 may be turned-on. When the fourth transistor M4 and the fifth transistor M5 are turned-on, the first power source ELVDD, the fourth transistor M4, the second transistor M2, the fifth transistor M5, and the organic light emitting diode (OLED) may be electrically coupled. Thus, the second transistor M2 may supply a current, corresponding to the voltage applied to the second node N2, to the organic light emitting diode (OLED), so as to illuminate the organic light emitting diode (OLED).

Also during the third period T3, the seventh transistor M7 may be maintained in the turned-on state by a scan signal supplied to the next scan line Si+1. Accordingly, the fourth node N4 may be supplied with a voltage Voled applied to the organic light emitting diode (OLED) during the third period T3.

Thereafter, during a fourth period T4, the scan signal supplied to the scan line Si+1 and the light emitting control signal supplied to the light emitting control line Ei+1 may stop. When the supply of the scan signal to the scan line Si+1 stops, the seventh transistor M7 may be turned-off. When the supply of the light emitting control line to the light emitting control signal Ei+1 stops, the ninth transistor M9 may be turned off and the eighth transistor M8 may be turned-on.

When the eighth transistor M8 is turned-on, the voltage of the fourth node N4 may rise from the voltage Voled of the organic light emitting diode (OLED) to the voltage of the first power source ELVDD. Further, since the ninth transistor M9 may be turned-off during the fourth period T4, the fifth node N5 may be set to a floating state. Accordingly, the voltage of the fifth node N5 may rise by an amount corresponding to the increase in voltage of the fourth node N4. Likewise, the voltage of the second node N2, which may also be in a floating state, may rise by an amount corresponding to the rise in the voltage of the fifth node N5. Thus, the voltage of the second node N2 may be controlled corresponding to the amount of voltage rise of the fourth node N4 in the fourth period T4, and, subsequently, the second transistor M2 may supply the current corresponding to the voltage applied to the second node N2 to the organic light emitting diode (OLED).

The organic light emitting diode (OLED) may deteriorate over time, e.g., due to exposure to air and/or moisture, or due to operation of the organic light emitting diode (OLED). If the organic light emitting diode (OLED) is deteriorated, the voltage Voled applied to the organic light emitting diode (OLED) may rise, i.e., when the current is supplied to the organic light emitting diode (OLED), the voltage applied to the organic light emitting diode (OLED) may rise as the organic light emitting diode (OLED) is deteriorated.

As the organic light emitting diode (OLED) is deteriorated, the amount of the voltage rise at the fourth node N4 may become smaller due to a rise in the voltage Voled of the organic light emitting diode (OLED) supplied to the fourth node N4. When the voltage Voled applied to the organic light emitting diode (OLED) rises, the amount of voltage rise may be reduced when the voltage of the first power source ELVDD is supplied to the fourth node N4. Moreover, as the amount of the voltage rise of the fourth node N4 is reduced, the amount of the voltage rise of the fifth node N5 and the second node N2 may be correspondingly reduced. Accordingly, the amount of current supplied from the second transistor M2 to the organic light emitting diode (OLED) may increase for a given data signal. Thus, according to the first embodiment, as the organic light emitting diode (OLED) deteriorates, the amount of current supplied from the second transistor M2 may increase so that degradation in brightness due to the deterioration of the organic light emitting diode (OLED) may be compensated.

Figure 4:
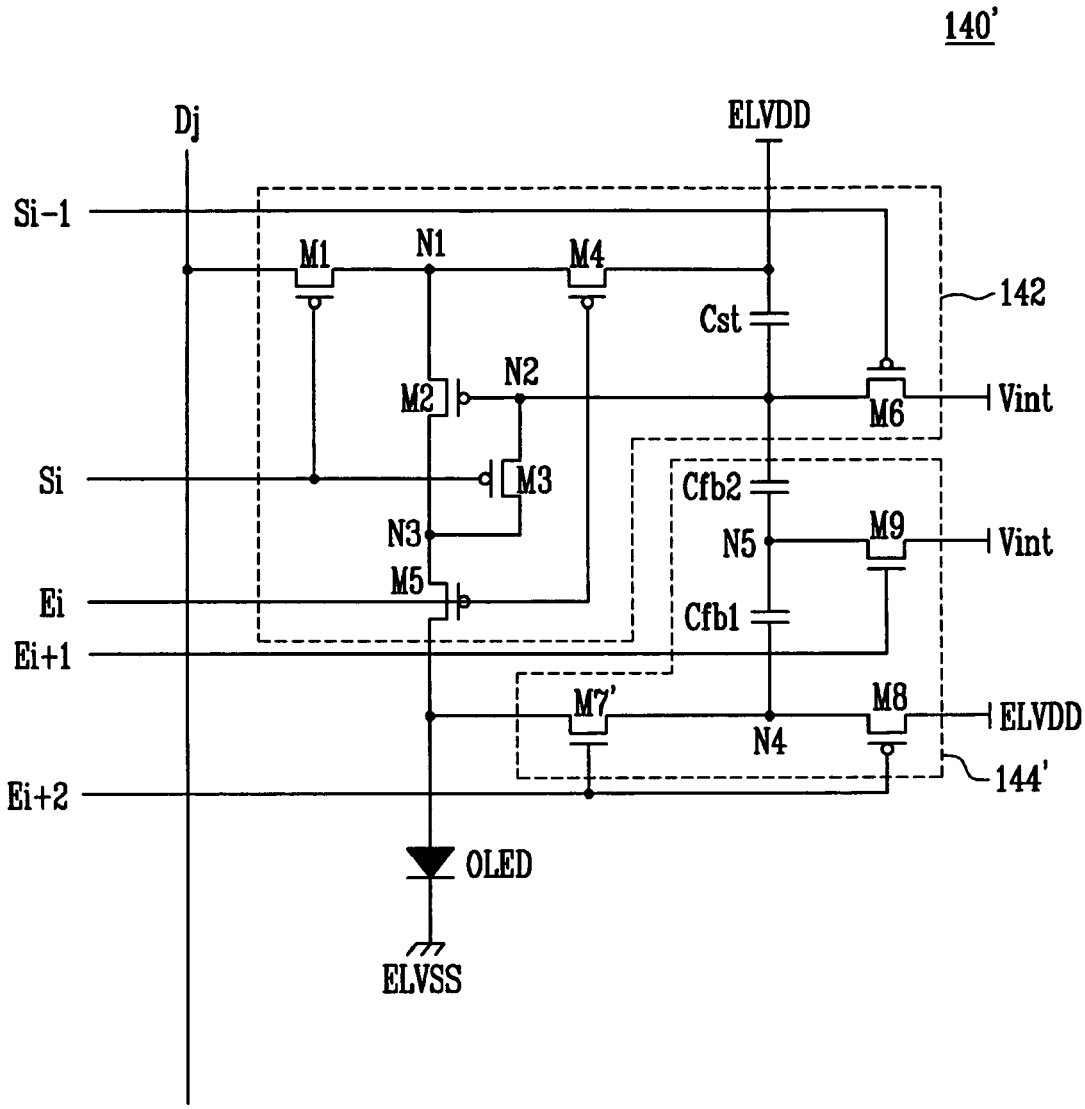
FIG. 4 illustrates a schematic view of a pixel according to a second embodiment.

FIG. 4 illustrates a schematic view of a pixel 140' according to a second embodiment. For convenience of explanation, FIG. 4 illustrates a pixel 140' positioned at the $i^{th}$ horizontal line and coupled to the $j^{th}$ data line (Dj).

The pixel 140' may be similar to the pixel 140 described above. In particular, the pixel 140' may include the pixel circuit 142, which may be coupled to light emitting control line Ei, scan lines Si−1 and Si, and data line Dj, in the same manner as the pixel circuit 142 described above in connection with the first embodiment. The pixel 140' may also include a compensating unit 144', which may be similar to the compensation unit 144 described above in connection with the first embodiment, except for the construction of a seventh transistor M7' and the configuration of the signal lines coupled to the compensation unit 144'. In particular, the compensating unit 144' may have an NMOS transistor as the seventh transistor M7', whereas the compensating unit 144 may have a PMOS transistor as the seventh transistor M7. Further, in the compensating unit 144', the seventh transistor M7' and the eighth transistor M8 may both be coupled to an $i+2^{th}$ light emitting control line Ei+2. Additionally, in the compensating unit 144', the ninth transistor M9 may be coupled to the initialization power source Vint, whereas, in the compensating unit 144, the ninth transistor M9 may be coupled to the first power source ELVDD. In an organic light emitting display including pixels 140', scan lines S0 to Sn and light emitting control lines E1 to En+2 may be provided (not shown), which may be coupled to a suitably configured scan driver. In the following description of the second embodiment, the description of features that are the same as those in the first embodiment may be omitted in order to avoid repetition.

Referring to FIG. 4, the pixel 140' at the $i^{th}$ horizontal line may be coupled to the $i-1^{th}$ scan line Si−1, the $i^{th}$ scan line Si, the $i^{th}$ light emitting control line Ei, the $i+1^{th}$ light emitting control line Ei+1, and the i+2 light emitting control line Ei+2.

In the pixel 140' according to the second embodiment, the ninth transistor M9 may be coupled between the fifth node N5 and the initialization power source Vint. The ninth transistor M9 may be turned-on when the light emitting control signal is supplied to the $i+1^{th}$ light emitting control line Ei+1, and may thus supply the initialization power source Vint to the fifth node N5.

The initialization power source Vint supplied to the fifth node N5 may maintain the voltage of the fifth node N5 constant, irrespective of a voltage change of the second node N2. The ninth transistor M9 may be coupled to the initialization power source Vint or the first power source ELVDD to allow the voltage of the fifth node N5 to be maintained constant.

Also, in the pixel 140' according to the second embodiment, the gate electrodes of the seventh transistor M7' and the eighth transistor M8 may be coupled to the i+2 light emitting control line Ei+2. The seventh transistor M7' and the eighth transistor M8 may thus be alternately turned-on and turned-off, i.e., they may operate in opposition such that one is turned-off while the other is turned-on. In an implementation, the seventh transistor M7' may be an NMOS transistor and the eighth transistor M8 may be a PMOS transistor.

Figure 5:
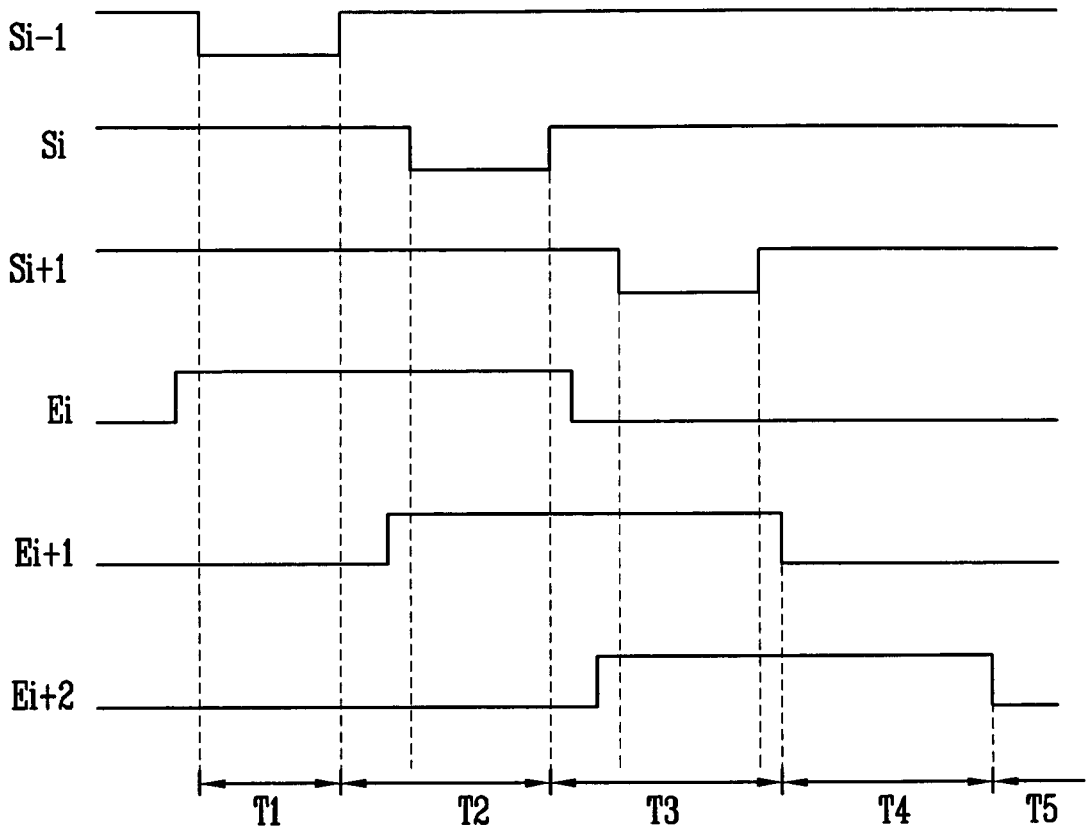
FIG. 5 illustrates waveforms for driving the pixel illustrated in FIG. 4.

FIG. 5 illustrates waveforms for driving the pixel 140' illustrated in FIG. 4. In particular, FIG. 5 illustrates the waveforms shown in FIG. 3, in addition to a waveform applied to the $i+2^{th}$ light emitting control line Ei+2.

Referring to FIGS. 4 and 5, during the first period T1, the scan signal may be supplied to the $i-1^{th}$ scan line Si−1 and the light emitting control signal may be supplied to the $i^{th}$ light emitting control line Ei. When the light emitting control signal is supplied to the $i^{th}$ light emitting control line Ei, the fourth transistor M4 and the fifth transistor M5 may be turned-off. When the scan signal is supplied to the $i-1^{th}$ scan line Si−1, the sixth transistor M6 may be turned-on. When the sixth transistor M6 is turned-on, the voltage of the second node N2 may be initialized with the initialization power source Vint. The initialization power source Vint may be set to a voltage that is lower than that of the data signal.

During the second period T2, the supply of the scan signal to the $i-1^{th}$ scan line Si−1 may stop. A light emitting control signal may be supplied to the $i+1^{th}$ light emitting control line Ei+1 during the second period T2. When the supply of the scan signal to the scan line $Si-1^{th}$ 1 stops, the sixth transistor M6 may be turned-off. The scan signal may be supplied to the subsequent scan line Si during the second period T2, such that the first transistor M1 and the third transistor M3 may be turned-on.

When the third transistor M3 is turned-on, the second transistor M2 may be diode-connected. When the first transistor M1 is turned-on, the data signal supplied to the data line Dj may be supplied to the first electrode of the second transistor M2 via the first node N1. As described above, the voltage of the second node N2 may be initialized with the voltage of the initialization power source Vint during the first period T1, and the second transistor M2 may be turned-on. Accordingly, during the second period T2, the data signal supplied by the first transistor M1 may be supplied to the second node N2 via the second transistor M2, the third node N3, and the third transistor M3. Accordingly, the second node N2 may be supplied with a voltage corresponding to the data signal and the threshold voltage of the second transistor M2. The storage capacitor Cst may be charged with a voltage corresponding to the voltage supplied to the second node N2.

Also during the second period T2, when the light emitting control signal is supplied to the $i+1^{th}$ light emitting control line Ei+1, the ninth transistor M9 may be turned-on. When the ninth transistor M9 is turned-on, the voltage of the initialization power source Vint may be supplied to the fifth node N5. Thus, the fifth node N5 may maintain the voltage of the initialization power source Vint during the period where the voltage corresponding to the data signal is applied.

The light emitting control signal supplied to the $i^{th}$ light emitting control line Ei and the scan signal supplied to the $i^{th}$ scan line Si may stop during a third period T3. When the supply of the scan signal to the $i^{th}$ scan line Si stops, the first transistor M1 and the third transistor M3 may be turned-off. When the supply of the light emitting control signal to the light emitting control line Ei stops, the fourth transistor M4 and the fifth transistor M5 may be turned-on. When the fourth transistor M4 and the fifth transistor M5 are turned-on, the first power source ELVDD, the fourth transistor M4, the second transistor M2, the fifth transistor M5, and the organic light emitting diode (OLED) may be electrically coupled. Thus, the second transistor M2 may supply a current, corresponding to the voltage applied to the second node N2, to the organic light emitting diode (OLED), so as to illuminate the organic light emitting diode (OLED).

Meanwhile, when the light emitting control signal is supplied to the $i+2^{th}$ light emitting control line Ei+2, the seventh transistor M7' may be turned-on, and the voltage Voled applied to the organic light emitting diode OLED may be supplied to the fourth node N4.

During the fourth period T4, the supply of the light emitting control signal to the $i+1^{th}$ light emitting control line Ei+1 may stop. When the supply of the light emitting control signal to the light emitting control line Ei+1 stops, the ninth transistor M9 may be turned-off, and the fifth node N5 may thus be placed in a floating state.

During a fifth period T5, the supply of the light emitting control signal to the $i+2^{th}$ light emitting control line Ei+2 may stop. Accordingly, during the fifth period T5, the seventh transistor M7' may be turned-off, and the eighth transistor M8 may be turned-on. When the eighth transistor M8 is turned-on, the voltage of the fourth node N4 may rise from the voltage Voled of the organic light emitting diode (OLED) to the voltage of the first power source ELVDD. At this time, since the fifth node N5 may be in a floating state, the voltage of the fifth node N5 may rise by an amount corresponding to the amount of voltage rise of the fourth node N4. Further, the voltage of the second node N2 set to the floating state may rise by a voltage amount corresponding to the amount of voltage rise of the fifth node N5. Thus, the voltage of the second node N2 may be controlled corresponding to the amount of voltage rise of the fourth node N4 in the fifth period T5. Subsequently, the second transistor M2 may supply current, in an amount corresponding to the voltage applied to the second node N2, to the organic light emitting diode (OLED).

As in the first embodiment, the organic light emitting diode (OLED) may deteriorate over time. As the organic light emitting diode (OLED) deteriorates, the voltage applied to the organic light emitting diode (OLED) may rise, i.e., when the current is supplied to the organic light emitting diode (OLED), the voltage Voled applied to the organic light emitting diode (OLED) may rise as the organic light emitting diode (OLED) deteriorates. Then, the current amount supplied from the second transistor M2 to the organic light emitting diode (OLED) may increase for a given data signal. Thus, as the organic light emitting diode (OLED) deteriorates, the amount of current supplied from the second transistor M2 may increase so that a degradation in brightness due to the deterioration of the organic light emitting diode (OLED) may be compensated.

As described above, embodiments may compensate for a deterioration in characteristics of an organic light emitting diode by controlling a voltage of a gate electrode of a driving transistor in correspondence with the deterioration of the organic light emitting diode. Further, the threshold voltage of the driving transistor may be compensated, such that images with uniform brightness may be displayed despite deviation in the threshold voltage.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A pixel, comprising:

an organic light emitting diode;

a first transistor controlling a current supplied to the organic light emitting diode;

a pixel circuit configured to compensate a threshold voltage of the first transistor; and a compensating unit controlling a voltage of a gate electrode of the first transistor in order to compensate for deterioration of the organic light emitting diode, wherein the compensating unit includes:

second and third transistors coupled in series between the organic light emitting diode and a first power source, the second and third transistors being commonly connected to a first node therebetween, first and second feedback capacitors coupled in series between the first node and a second node, the second node being coupled to the gate electrode of the first transistor, and a fourth transistor coupled between a predetermined voltage source and a third node that is common to the first and second feedback capacitors, wherein the pixel circuit includes:

a fifth transistor having a gate electrode coupled to an $i^{th}$ scan line, the fifth transistor being turned-on to couple a data line to a first electrode of the first transistor when a scan signal is supplied to the $i^{th}$ scan line, a sixth transistor having a gate electrode coupled to the $i^{th}$ scan line, the sixth transistor being turned-on to couple a second electrode of the first transistor to the second node when the scan signal is supplied to the $i^{th}$ scan line, a seventh transistor having a gate electrode coupled to an $i-1^{th}$ scan line, the seventh transistor being turned-on to couple an initialization power source to the second node when a scan signal is supplied to the $i-1^{th}$ scan line, an eighth transistor having a gate electrode coupled to an $i^{th}$ light emitting control line, the eighth transistor being turned-on to couple the first electrode of the first transistor to the first power source when a light emitting control signal is not supplied to the $i^{th}$ light emitting control line, a ninth transistor having a gate electrode coupled to the $i^{th}$ light emitting control line, the ninth transistor being turned-on to couple the second electrode of the first transistor to the organic light emitting diode when the light emitting control signal is not supplied to the $i^{th}$ light emitting control line, and a storage capacitor coupled between the second node and the first power source, wherein:

the $i^{th}$ scan line is defined with i as a natural number; and the $i^{th}$ light emitting control line is defined with i as a natural number.

2. The pixel as claimed in claim 1, wherein the predetermined voltage source is the initialization power source.

3. The pixel as claimed in claim 1, wherein the second and third transistors operate in opposition to one another.

4. The pixel as claimed in claim 1, wherein the third and fourth transistors operate in opposition to one another.

5. The pixel as claimed in claim 4, wherein the third transistor is a PMOS transistor and the fourth transistor is an NMOS transistor.

6. The pixel as claimed in claim 1, wherein the predetermined voltage source is the first power source.

7. The pixel as claimed in claim 1, wherein:

the second and third transistors have gate electrodes coupled to an $i+2^{th}$ light emission control line, and the second transistor is an NMOS transistor and the third transistor is a PMOS transistor.

8. A display, comprising;

a scan driver coupled to scan lines and light emitting control lines;

a data driver coupled to data lines; and a plurality of pixels as claimed in claim 1, the pixels being coupled to the scan lines, the data lines, and the light emitting control lines.

9. The display as claimed in claim 8, wherein the initialization power source is set to a voltage that is lower than a voltage of a data signal applied to the data line.

10. The display as claimed in claim 8, wherein:

the scan driver supplies a light emitting control signal to the $i^{th}$ light emitting control line such that it overlaps with scan signals supplied to the $i-1^{th}$ scan line and the $i^{th}$ scan line, and the scan driver supplies a light emitting control signal to an $i+1^{th}$ light emitting control line such that it overlaps with scan signals supplied to the $i^{th}$ scan line and an $i+1^{th}$ scan line.

11. The display as claimed in claim 10, wherein:

the second transistor is turned on when the scan signal is supplied to the $i+1^{th}$ scan line, and the third transistor is turned off when the light emitting control signal is supplied to the $i+1^{th}$ light emitting control line.

12. The display as claimed in claim 11, wherein the third and fourth transistors operate in opposition to one another.

13. The display as claimed in claim 12, wherein the third transistor is a PMOS transistor and the fourth transistor is an NMOS transistor.

14. The display as claimed in claim 10, wherein:

the scan driver supplies a light emitting control signal to an $i+2^{th}$ light emitting control line such that it overlaps with the scan signal supplied to the $i+2^{th}$ scan line, the second transistor is turned on when the light emitting control signal is supplied to the $i+2^{th}$ light emitting control line, and the third transistor is turned off when the light emitting control signal is supplied to the $i+2^{th}$ light emitting control line.

15. The display as claimed in claim 14, wherein:

the second and third transistors have gate electrodes coupled to the $i+2^{th}$ light emission control line, the second transistor is an NMOS transistor, and the third transistor is a PMOS transistor.

16. The display as claimed in claim 14, wherein the predetermined voltage source is the initialization power source.

17. The display as claimed in claim 8, wherein:

the initialization power source initializes a voltage of the gate electrode of the first transistor, and the sixth transistor diode-connects the first transistor to charge a voltage corresponding to a threshold voltage of the first transistor and a data signal in the storage capacitor.

18. The display as claimed in claim 17, wherein:

the second transistor couples the first node to the organic light emitting diode while a current is supplied to the organic light emitting diode, such that a voltage at the organic light emitting diode is applied to the first node, subsequently, the third transistor couples the first node to the first power source, such that the voltage of the first node is raised to the voltage of the first power source, and the first and second feedback capacitors transmit the voltage rise of the first node to the second node.

19. The display as claimed in claim 8, wherein the second and third transistors operate in opposition to one another.

20. A method of driving a display having first and second transistors coupled in series between an anode electrode of an organic light emitting diode and a first power source, and first feedback and second feedback capacitors coupled in series between a first node, which is a node common to the first and second transistors, and a gate electrode of a driving transistor, the method including:

initializing a voltage of the gate electrode of the driving transistor with a voltage of an initialization power source;

charging a voltage corresponding to a threshold voltage of the driving transistor and a data signal in a storage capacitor by diode-connecting the driving transistor;

supplying a current corresponding to the voltage charged in the storage capacitor to the organic light emitting diode;

applying a voltage applied to the organic light emitting diode to the first node;

maintaining a second node, which is common to the first and second feedback capacitors, at a constant voltage while charging the voltage in the storage capacitor and supplying the voltage applied to the organic light emitting diode to the first node; and controlling the voltage of the gate electrode of the driving transistor by setting the second node to a floating state and, at the same time, raising the voltage of the first node to the voltage of the first power source.

21. The method as claimed in claim 20, wherein the constant voltage is the voltage supplied from any one of the initialization power source and the first power source.

22. The method as claimed in claim 20, wherein the initialization power source is set to a voltage that is lower than that of the data signal.

23. The method as claimed in claim 20, wherein the first and second transistors operate in opposition to one another.

24. A pixel, comprising:

an organic light emitting diode;

a first transistor controlling a current supplied to the organic light emitting diode;

a pixel circuit configured to compensate a threshold voltage of the first transistor; and a compensating unit controlling a voltage of a gate electrode of the first transistor in order to compensate for deterioration of the organic light emitting diode, wherein the compensating unit includes:

second and third transistors coupled in series between the organic light emitting diode and a first power source, the second and third transistors operating in opposition to one another, the second and third transistors being commonly connected to a first node therebetween, first and second feedback capacitors coupled in series between the first node and a second node, the second node being coupled to the gate electrode of the first transistor, and a fourth transistor coupled between a predetermined voltage source and a third node that is common to the first and second feedback capacitors, wherein:

the second and third transistors are coupled in series between the organic light emitting diode and the first power source such that placing the second transistor in an 'on' state and, at the same time, placing the third transistor in an 'on' state would allow an electric current to flow from the first power source through the third transistor to the second transistor and then to the organic light emitting diode, and the fourth transistor is coupled between the predetermined voltage source and the third node such that placing the fourth transistor in an 'on' state would allow an electric current to flow from the predetermined voltage source through the fourth transistor to the third node.

25. A display, comprising;

a scan driver coupled to scan lines and light emitting control lines;

a data driver coupled to data lines; and a plurality of pixels as claimed in claim 24, the pixels being coupled to the scan lines, the data lines, and the light emitting control lines.

* * * * *